US012390706B2

(12) United States Patent
Kikuchi et al.

(10) Patent No.: US 12,390,706 B2
(45) Date of Patent: Aug. 19, 2025

(54) BAT SYSTEM WITH PERFORMANCE LIMITING STRUCTURE AND METHODS OF MAKING SAME

(71) Applicant: Mizuno Corporation, Osaka (JP)

(72) Inventors: Kohei Kikuchi, Osaka (JP); Yohei Yamashita, Osaka (JP); David Llewellyn, Norcross, GA (US); Thu Van Nguyen, Fujian (CN); Chi-Hung Lee, Fujian (CN); Renqin Zhang, Fujian (CN); Katsuhisa Hirano, Osaka (JP)

(73) Assignee: Mizuno Corporation, Osaka (JP)

( * ) Notice: Subject to any disclaimer, the term of this patent is extended or adjusted under 35 U.S.C. 154(b) by 326 days.

(21) Appl. No.: 18/079,319

(22) Filed: Dec. 12, 2022

(65) Prior Publication Data

US 2023/0113166 A1 Apr. 13, 2023

Related U.S. Application Data

(63) Continuation-in-part of application No. 17/223,126, filed on Apr. 6, 2021, now Pat. No. 11,524,215, which is a continuation-in-part of application No. 16/661,208, filed on Oct. 23, 2019, now Pat. No. 10,967,235.

(60) Provisional application No. 62/749,759, filed on Oct. 24, 2018.

(51) Int. Cl.

| | |
|---|---|
| ***A63B 59/00*** | (2015.01) |
| ***A63B 59/50*** | (2015.01) |
| *A63B 102/18* | (2015.01) |

(52) U.S. Cl.
CPC ..... *A63B 59/50* (2015.10); *A63B 2102/18* (2015.10); *A63B 2102/182* (2015.10); *A63B 2209/00* (2013.01)

(58) Field of Classification Search
CPC ..... A63B 59/50
USPC ..... 473/564
See application file for complete search history.

(56) References Cited

U.S. PATENT DOCUMENTS

| | | | | |
|---|---|---|---|---|
| 1,367,492 A * | 2/1921 | Miles | A63B 59/50 | 473/564 |
| 1,665,195 A * | 4/1928 | Cohn | A63B 59/50 | 473/520 |
| 4,951,948 A * | 8/1990 | Peng | A63B 59/50 | 473/520 |
| 6,994,641 B2 * | 2/2006 | Hebreo | A63B 60/06 | 473/520 |

(Continued)

*Primary Examiner* — Mitra Aryanpour
(74) *Attorney, Agent, or Firm* — TROUTMAN PEPPER LOCKE LLP; James E. Schutz; Korbin M. Blunck

(57) ABSTRACT

A bat, which has a hollow barrel and an internal assembly configured to resist deformation of the hollow barrel, is disclosed. The internal assembly includes a rod disposed longitudinally in the hollow barrel, a ring attached to the rod, a deformable sleeve disposed around the ring and extending longitudinally in the hollow barrel. The sleeve can include an outer diameter smaller than an inner diameter of the hollow barrel. The bat can include an end cap attached to an end of the hollow barrel and having a recess configured to receive an end of the rod. The rod can be configured to maintain the deformable sleeve in a predetermined suspended position within the hollow barrel such that, when the bat is at rest, the sleeve is disposed a predetermined gap distance from an inner surface of the hollow barrel.

20 Claims, 14 Drawing Sheets

(56) References Cited

U.S. PATENT DOCUMENTS

| | | | | |
|---|---|---|---|---|
| 7,147,580 | B2 * | 12/2006 | Nutter | A63B 69/0002 473/457 |
| 8,062,154 | B2 * | 11/2011 | Burger | A63B 59/50 473/567 |
| 8,632,428 | B2 * | 1/2014 | Burger | A63B 59/50 473/566 |
| 10,967,235 | B2 * | 4/2021 | Kikuchi | A63B 60/16 473/457 |
| 11,524,215 | B2 * | 12/2022 | Kikuchi | A63B 59/58 473/457 |
| 2016/0129330 | A1 * | 5/2016 | Rodriguez | A63B 69/0002 473/564 |
| 2020/0129823 | A1 * | 4/2020 | Kikuchi | A63B 59/50 473/457 |
| 2021/0220713 | A1 * | 7/2021 | Kikuchi | A63B 59/50 473/457 |
| 2023/0113166 | A1 * | 4/2023 | Kikuchi | A63B 60/42 473/564 |

* cited by examiner

BAT SYSTEM WITH PERFORMANCE LIMITING STRUCTURE AND METHODS OF MAKING SAME

CROSS REFERENCE TO RELATED APPLICATIONS

This application is a continuation-in-part of U.S. patent application Ser. No. 17/223,126, filed 6 Apr. 2021 (Now U.S. Pat. No. 11,524,215), which is a continuation-in-part of U.S. patent application Ser. No. 16/661,208, filed 23 Oct. 2019 (Now U.S. Pat. No. 10,967,235), which claims priority under 35 U.S.C. § 119 to U.S. Provisional Patent Application No. 62/749,759, filed on 24 Oct. 2018 and entitled "Bat System with Performance Limiting Structure and Methods of Making Same," the contents of which are hereby incorporated by reference in their entirety.

BACKGROUND

Generally, the performance of a bat is related to the efficiency with which the bat can impart force to a ball upon impact. Bat manufacturers often evaluate a bat's coefficient of restitution (COR) to measure its performance. Previously, bat manufacturers typically sought to improve the performance of bats to achieve an increased COR. Today, however, bat manufacturers are typically concerned with manufacturing bats that provide the greatest performance possible but without exceeding maximum performance metrics of various leagues and other organized forms of play.

Generally, increased deformation experienced by a bat upon impact with a ball corresponds to an increased COR of the bat. Some existing bat designs aim to prevent a bat from exceeding an imposed COR limit by limiting deformation of the bat upon impact of the bat with a ball. For example, U.S. Pat. No. 8,632,428 to Burger describes a bat that includes a central tube positioned coaxially within the barrel and one or more rigid, "washer-shaped" restriction members to limit the deformation of the bat upon impact with a ball. The washer-shaped restriction members have an outer diameter that is less than the inner diameter of the barrel, such that the barrel is able to deform until the inner wall of the barrel contacts the washer-shaped restriction members. By controlling the amount of possible deformation, it is thus possible to control the amount of deformation experienced by a bat at impact, and thus, limit the maximum COR provided by the bat.

While such a design may sufficiently limit the maximum COR provided by a bat, the bat's performance at lower impact forces may be unnecessarily reduced. That is, at lower forces (e.g., lower swing speed or lower ball speed), deformation of the bat does not need to be limited to prevent the bat from exceeding the maximum COR limit, but the high rigidity and incompressibility of a washer-shaped restriction member would likely prevent deformation of the bat's barrel even at lower forces such that performance of the bat at the lower forces is unnecessarily reduced. More particularly, such a bat may perform substantially differently within three ranges of ball speed. At low speed impacts (e.g., a low speed range), only the barrel may flex. At higher speeds (e.g., a medium speed range), a single side of the barrel (e.g., the portion of the barrel impacting the ball) may engage the washer-shaped restriction member, and at still higher speeds (e.g., a high speed range), two sides of the barrel (e.g., the portion of the barrel impacting the ball and the portion of the barrel directly opposite the impact location) may engage the washer-shaped restriction member. For impacts in the high speed range, the incompressible nature of the washer-shaped restriction member may prevent flex of the washer-shaped restriction member and of the barrel system, as a whole, which can be detrimental to bat performance, particularly at high-force impacts (e.g., impacts with a ball in the high speed range).

What is needed, therefore, is a bat designed to maximize performance within a given set of guidelines at high impact forces while simultaneously maximizing absolute performance of the bat at lower impact forces. It is to such a bat that embodiments of the present invention are primarily directed.

SUMMARY

Embodiments of the present invention relate to a baseball or softball bat having a hollow barrel and one or more deformable rings suspending within the hollow barrel by a plurality of rods positioned longitudinally within the hollow barrel. Each of the plurality of rods can be offset from a central axis of the hollow barrel by a common radius, and the deformable ring can have a substantially circular outer wall that has a diameter less than an inner diameter of the hollow barrel. The deformable ring can also have a plurality of holes positioned equidistantly about a circumference corresponding to the common radius, with each hole at least partially receiving a rod of the three or more rods. Thus, the deformable ring can be positioned such that it is in coaxial alignment with the hollow barrel when the bat is at rest. Embodiments can also include an end cap that has holes extending partially therethrough, with each end cap hole at least partially receiving an end of a rod.

According the disclosed technology, a bat can include a hollow barrel and an internal assembly disposed within the hollow barrel. The internal assembly can comprise a plurality of rigid rods disposed longitudinally within the hollow barrel, an alignment insert, a deformable ring, and an end cap. The alignment insert can have an outer diameter approximately equal to an inner diameter of the hollow barrel and a plurality of through-holes that are each (i) axially extending through the alignment insert, (ii) offset from a central axis of the alignment insert by a common radius and positioned such that the plurality of through-holes is disposed equidistantly along a circumference corresponding to the common radius, and (iii) configured to receive a portion of a corresponding rigid rod. The deformable ring can comprise an outer wall having an outer diameter smaller than the inner diameter of the hollow barrel and a plurality of holes disposed equidistantly about the circumference corresponding to the common radius. Each hole of the deformable ring can be configured to at least partially receive a corresponding rigid rod. The end cap can be configured to insert into an end of the hollow barrel, and the end cap can have a plurality of recesses disposed equidistantly about the circumference corresponding to the common radius. Each recess can be configured to receive an end of a corresponding rigid rod. The end cap and the alignment insert can be configured to maintain the plurality of rigid rods in a predetermined configuration when the bat is at rest. The predetermined configuration can correspond to each of the plurality of rigid rods being parallel. The plurality of rigid rods can be configured to maintain the deformable ring in a predetermined suspended position within the hollow barrel such that, when the bat is at rest, each point along the outer wall of the deformable ring is disposed a predetermined gap distance from an inner surface of the hollow barrel.

The hollow barrel can be configured to flex inwardly responsive to receiving force from an impact with an object such that the inner surface of the hollow barrel contacts the outer wall of the deformable ring.

The hollow barrel can be configured to transfer at least some of the force from the impact to the deformable ring. The deformable ring can be configured to at least partially deform from an original shape to a deformed shaped upon receiving at least some of the force from the impact, and the deformable ring can be configured to return from the deformed shape to the original shape.

The deformable ring can be configured to transfer a rebound force to the hollow barrel as the deformable ring returns from the deformed shape to the original shape.

The alignment insert can have a plurality of lobes.

The alignment insert can comprise EVA foam.

The bat can comprise a plurality of deformable rings.

The deformable ring can comprise aluminum.

The deformable ring can comprise a plurality of inner lobes. Each of the plurality of holes of the deformable ring can be at least partially disposed within a corresponding inner lobe of the plurality of inner lobes.

The deformable ring can comprise a hollow inner portion.

At least some of the plurality of rigid rods can comprise carbon.

At least some of the plurality of rigid rods can be hollow.

At least some of the plurality of rigid rods can be substantially solid.

The end cap can comprise a protrusion configured to at least partially insert into a notch of the hollow barrel. The notch can be disposed on an interior wall of the hollow barrel proximate a distal end of the hollow barrel. The protrusion and notch can be configured to interlock.

According to the disclosed technology, a method for manufacturing a bat can comprise providing a hollow barrel and assembling an internal assembly. Assembling the internal assembly can include inserting each of a plurality of rigid rods into a corresponding through-hole of a plurality of through-holes in an alignment insert having an outer diameter approximately equal to an inner diameter of the hollow barrel. Each of the plurality of through-holes can be axially extending through the alignment insert and can be offset from a central axis of the alignment insert by a common radius and positioned such that the plurality of through-holes is disposed equidistantly along a circumference corresponding to the common radius. Assembling the internal assembly can include inserting each of the plurality of rigid rods into a corresponding hole of a plurality of holes in a deformable ring comprising an outer wall that has an outer diameter smaller than the inner diameter of the hollow barrel. The plurality of holes can be disposed equidistantly about the circumference corresponding to the common radius. Assembling the internal assembly can include inserting an end of each of the plurality of rigid rods into a corresponding recess of a plurality of recesses in an end cap. The plurality of recesses in the end cap can be disposed equidistantly about the circumference corresponding to the common radius. Assembling the internal assembly can include inserting the end cap into an end of the hollow barrel.

Assembling the internal assembly can comprise positioning the plurality of rigid rods such that the plurality of rigid rods is in a predetermined configuration when the bat is at rest. The predetermined configuration can correspond to each of the plurality of rigid rods being parallel.

Assembling the internal assembly can comprise positioning the deformable ring in a predetermined suspended position within the hollow barrel such that, when the bat is at rest, each point along the outer wall of the deformable ring is disposed a predetermined gap distance from an inner surface of the hollow barrel.

The disclosed technology can include a bat which has a hollow barrel and an internal assembly configured to resist deformation of the hollow barrel. The internal assembly can include a rod disposed longitudinally in the hollow barrel, a ring attached to the rod, a deformable sleeve disposed around the ring and extending longitudinally in the hollow barrel. The sleeve can include an outer diameter smaller than an inner diameter of the hollow barrel. The bat can include an end cap attached to an end of the hollow barrel and having a recess configured to receive an end of the rod. The rod can be configured to maintain the deformable sleeve in a predetermined suspended position within the hollow barrel such that, when the bat is at rest, the sleeve is disposed a predetermined gap distance from an inner surface of the hollow barrel.

Responsive to receiving force from an impact with an object, the hollow barrel can be configured to flex inwardly such that the inner surface of the hollow barrel contacts the deformable sleeve.

The hollow barrel can be configured to transfer at least some of the force from the impact to the deformable sleeve. The deformable sleeve can be configured to at least partially deform from an original shape to a deformed shaped upon receiving the at least some of the force from the impact and return from the deformed shape to the original shape.

The deformable sleeve can be further configured to transfer a rebound force to the hollow barrel as the deformable sleeve returns from the deformed shape to the original shape.

The ring can be a deformable ring and the hollow barrel can be configured to transfer at least some of the force from the impact to the deformable ring. The deformable ring can be configured to at least partially deform from an original shape to a deformed shaped upon receiving the at least some of the force from the impact and return from the deformed shape to the original shape.

The ring can be a first ring and the internal assembly can further include a second ring. The second ring can be attached to the rod and spaced a distance from the first ring. The sleeve can extend between the first ring and the second ring.

The sleeve can include a first outer diameter proximate the first ring and proximate the second ring and a second outer diameter between the first ring and the second ring. The second outer diameter can be greater than the first outer diameter. The second outer diameter can be less than the first outer diameter. The sleeve can include a first thickness proximate the first ring and proximate the second ring and a second thickness between the first ring and the second ring. The second thickness can be greater than the first thickness. The second thickness can be less than the first thickness.

The sleeve can comprise a composite material.

The internal assembly can further comprise an alignment insert comprising an outer diameter approximately equal to the inner diameter of the hollow barrel and a lobe configured to receive a portion of the rod.

The bat can further include a plurality of rods. The ring can comprise a plurality of holes. Each hole of the plurality of holes can be configured to at least partially receive a respective rod of the plurality of rods.

The bat can have a central axis and the ring can have a central axis aligned with the central axis of the bat. The plurality of holes of the ring can be disposed equidistantly about a circumference corresponding to a radial distance from the central axis of the bat.

The end cap can further comprise a plurality of recesses configured to at least partially receive an end of a respective rod of the plurality of rods. The end cap can have a central axis aligned with the central axis of the bat and the plurality of recesses of the end cap can be disposed equidistantly about a circumference corresponding to a radial distance from the central axis of the bat.

The bat can further include an alignment insert comprising an outer diameter approximately equal to the inner diameter of the hollow barrel and a plurality of lobes. Each lobe can be configured to at least partially receive a respective rod of the plurality of rods. Each of the plurality of lobes of the alignment insert can be offset from a central axis of the alignment insert by a radial distance. The plurality of lobes of the alignment insert can be disposed equidistantly along a circumference corresponding to the radial distance.

The disclosed technology can include an internal assembly for a bat comprising a rod, a deformable ring attached to the rod, and a deformable sleeve disposed around the deformable ring and configured to extend longitudinally in a hollow barrel of the bat. The sleeve can have an outer diameter smaller than an inner diameter of the hollow barrel. The rod can be configured to maintain the deformable sleeve in a predetermined suspended position within the hollow barrel such that, when the bat is at rest, the sleeve is disposed a predetermined gap distance from an inner surface of the hollow barrel.

The ring can be a first ring and the internal assembly can further comprise a second ring. The second ring can be attached to the rod and spaced a distance from the first ring. The sleeve can extend between the first ring and the second ring. The internal assembly can further comprise an alignment insert comprising an outer diameter approximately equal to an inner diameter of a hollow barrel of the bat and a lobe configured to at least partially receive a portion of the rod.

These and other objects, features and advantages of the present invention will become more apparent upon reading the following specification in conjunction with the accompanying drawing figures.

BRIEF DESCRIPTION OF THE FIGURES

Reference will now be made to the accompanying figures, which are not necessarily drawn to scale, and wherein.

DETAILED DESCRIPTION

Figure 1:
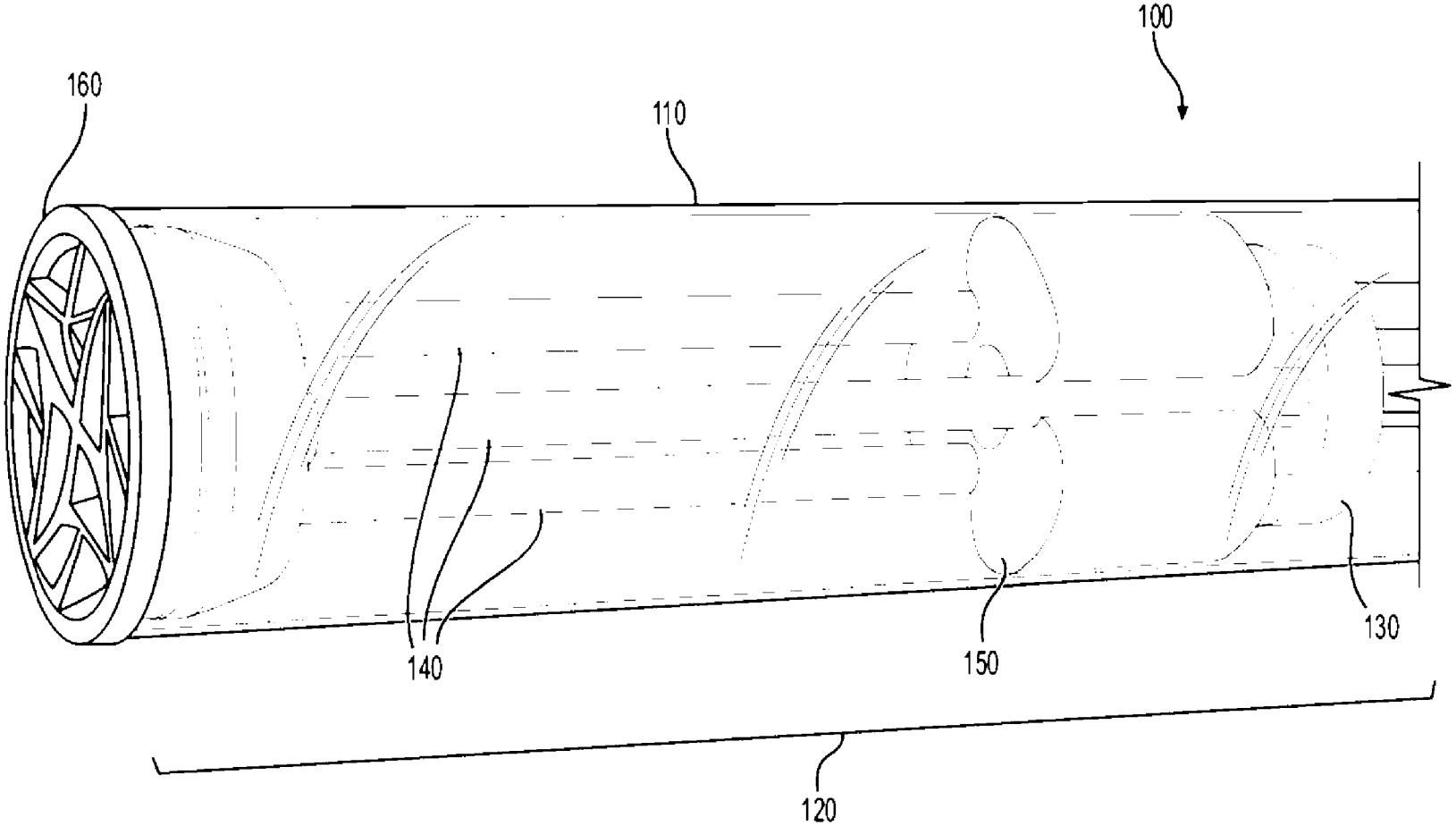
FIG. 1 is an isometric view of a bat with the barrel depicted as transparent for clarity, according to some embodiments of the disclosed technology.

Throughout this disclosure, certain example embodiments are described in relation to bats including a plurality of rods and a deformable ring. Some embodiments of the disclosed technology will be described more fully hereinafter with reference to the accompanying drawings. This disclosed technology may, however, be embodied in many different forms and should not be construed as limited to the embodiments set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

According to some embodiments, the disclosed technology relates to a bat, such as baseball bat or a softball bat. In some embodiments, the bat can include a hollow barrel and an internal assembly that is configured to resist deformation of the hollow barrel, especially deformation of the hollow barrel upon impact with a ball, for example. In certain embodiments, the internal assembly can be configured to resist, but not entirely prevent, deformation of the bat upon contact the hollow barrel's inner wall with an outer edge or surface of the deformable ring. In certain embodiments, the internal assembly can include a deformable ring that is suspended within the hollow barrel by a plurality of rods that extend longitudinally within the hollow barrel.

Figure 2:
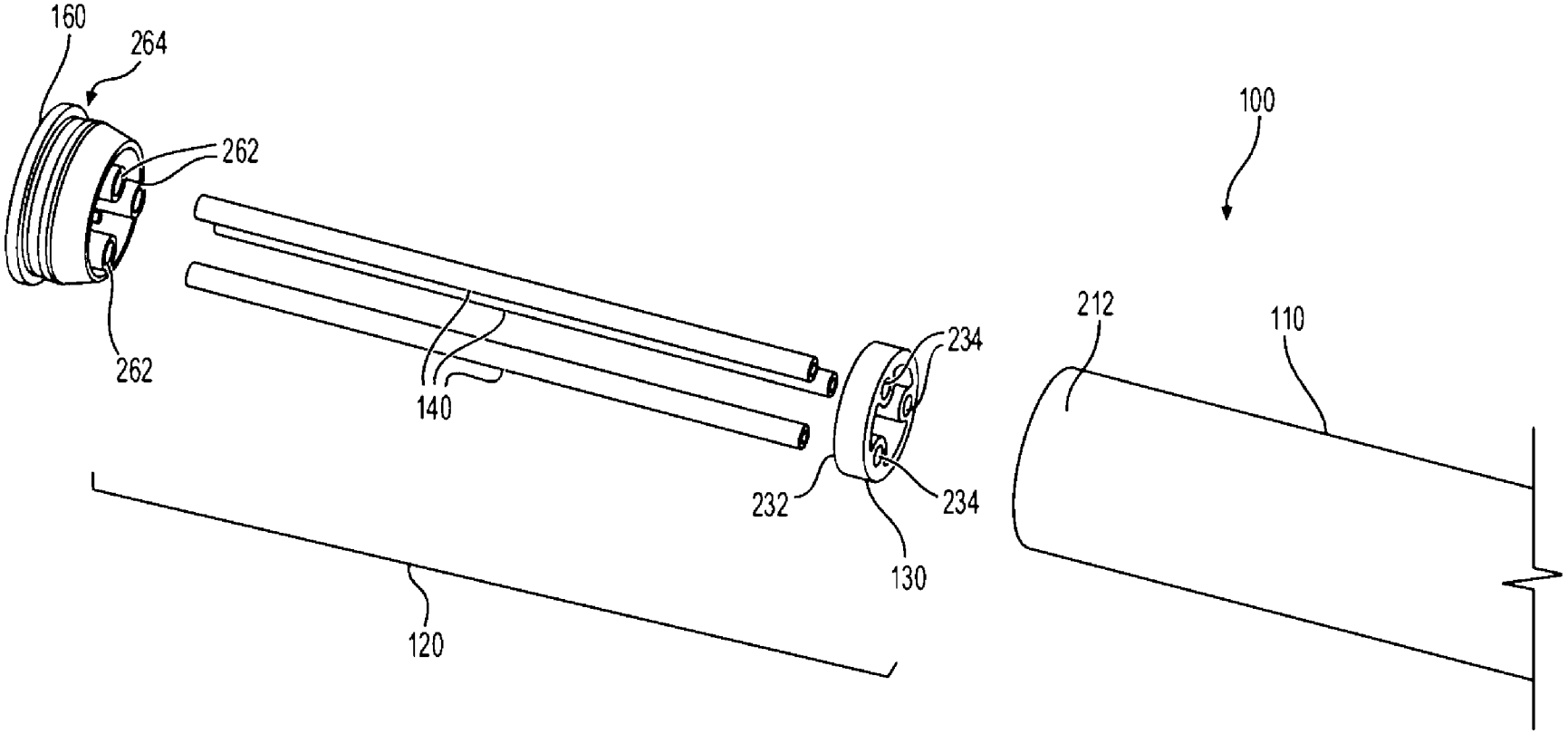
FIG. 2 is an exploded view of a bat, according to some embodiments of the disclosed technology.

FIG. 1 is an isometric view of a bat 100 according to some embodiments of the disclosed technology. The bat 100 can include a barrel 110, which is depicted as transparent in FIG. 1 to clearly show the internal components of the bat 100. In some embodiments, the bat 100 can include an internal assembly 120, which can include one or more deformable rings 130 and a plurality or rods 140. The deformable ring(s) 130 can be configured to limit (but not prevent) barrel flex at comparatively high impact forces while still allowing the barrel 110 to freely flex at comparatively low impact forces. In certain embodiments, a deformable ring 130 can be placed at a location along the length of the barrel 110 corresponding to the peak performance of the bat 100, or the bat's "sweet spot." While some embodiments may include a single deformable ring 130, other embodiments can include two, three, four, five, six, or more deformable rings 130. Increasing the number of deformable rings 130 can provide a more constant control of deformation of the hollow barrel 110 upon impact with a ball, but increasing the number deformable rings 130 can also increase the overall weight of the bat 100, which can negatively impact performance of the bat 100. To provide uniformity of deformation about the exterior diameter of the bat 100, some embodiments can include three or more rods 140. For example, some embodiments can include three, four, five, six, or more rods 140. Similar to the number of deformable rings 130 used, an increased number of rods 140 can provide increased positional securely of the deformable ring 130, but increasing the number of rods 140 can increase the overall weight of the bat 100, which may negatively impact the performance of the bat 100. Accordingly, some embodiments can include as few as two rods 140, which can reduce the overall weight of the bat 100, but may do so at the cost of uniformity of deformation about the exterior diameter of the bat 100. Some embodiments can also include an alignment insert 150, which can provide limited or no effect on the deformation of the hollow barrel 110. According to some embodiments, the rods 140 can be solid. In some embodiments, the rods 140 can be substantially hollow, such as is depicted in FIG. 2. According to some embodiments, the rods 140 can comprise carbon tubes. In certain embodiments, the rods 140 can comprise metal, resin, carbon, glass fibers, or some mixture thereof. In some embodiments, each rod 140 can have a diameter in the range of approximately 1 mm to approximately 50 mm. For example, some embodiments can include rods 140 having a diameter in the range of approximately 5 mm to approximately 30 mm.

In some embodiments, the alignment insert 150 can have a shape that mirrors the interior shape of the hollow barrel 110. For example, the alignment insert 150 can have a substantially cylindrical shape. Alternately, the alignment insert 150 can have a frustoconical shape. The alignment insert 150 can have an exterior diameter that is substantially equal to the interior diameter of the hollow barrel 110. The alignment insert 150 can include a plurality of holes or lobes extending axially therethrough. Each hole of the alignment insert 150 can be positioned at a common radius from a center of the alignment insert 150, and in certain embodiments, the holes can be positioned equidistantly about a circumference corresponding to this common radius. Each hole of the alignment insert 150 can be dimensioned to receive a corresponding rod 140. The alignment insert 150 can include a plurality of axially extending slits, and each slit can align with a corresponding hole of the alignment insert 150. Thus, each hole of the alignment insert 150 can be configured to receive a rod 140 through the slit such that each rod 140 is passed through a slit and into a corresponding hole in a radially inward direction.

The alignment insert 150 can have other shapes. For example, the alignment insert 150 can have a plurality of lobes formed between adjacent niches, such as is shown in FIG. 1. Each niche can correspond to a rod 140 of the internal assembly 120, and each niche can be configured to receive at least a portion of the corresponding rod 140. Regardless of the shape, in some embodiments, the alignment insert 150 can be configured to substantially maintain the rods 140 in a predetermined alignment and/or position. In addition, the alignment insert 150 can also provide subjective benefits regarding the sound of the bat 100 striking a ball (i.e., the ball-striking sound of a bat 100 with an alignment insert 150 can be more pleasing to a general audience than the ball-striking sound of a bat 100 without an alignment insert 150). In some embodiments, the alignment insert 150 can comprise a light yet sturdy material. In some embodiments, the alignment insert 150 can comprise a polymer, copolymer, and/or foam, such as EVA foam. The alignment insert 150 can include a central hole (e.g., as shown in FIG. 1), which can reduce the weight of the alignment insert 150 (and thus the overall weight of the bat 100). The central hole can be dimensioned such that weight is reduced without negatively impacting the necessary rigidity of the alignment insert 150 that is required to maintain the rods 140 in alignment with other components of the internal assembly 120 and/or other components of the bat 100. Certain embodiments can exclude the alignment insert 150. In some embodiments, the bat 100 can include an end cap 160. As discussed more fully below, in some embodiments, the end cap 160 can be configured to fit securely into a distal end of the barrel 110 and can be configured to receive an end of each of a plurality of rods 140 and maintain the end of each rod 140 in a predetermined alignment and/or position.

Referring to FIG. 2, the deformable ring 130 can include a circular outer wall 232 and a plurality of holes 234, where each hole 234 is configured to at least partially receive a rod 140. In some embodiments, the circular outer wall 232 has an outer diameter that is less than an inner diameter of the hollow barrel 110 such that, upon impact of the hollow barrel 110 with a ball, the hollow barrel 110 is permitted to deform a predetermined amount or a predetermined distance before contacting the circular outer wall 232 of the deformable ring 130. According to some embodiments, the deformable ring 130 is configured to at least partially deform upon receiving force from the impact of the hollow barrel 110 with a ball via contact of the hollow barrel 110 with the circular outer wall 232 of the deformable ring 130. In some embodiments, the deformable ring 130 can be configured to return to its original shape subsequent to deforming.

According to certain embodiments, the deformable ring 130 can include one or more holes 234 that extend entirely through the deformable ring 130. Each hole 234 can be located in a corresponding inner lobe 436 of the deformable ring 130 (e.g., as shown in FIGS. 4A-4D). In some embodiments, each hole 234 of the deformable ring 130 can be positioned at a common radius from a center of the deformable ring 130, and in certain embodiments, the holes 234 can be positioned equidistantly about a circumference corresponding to this common radius. The positions of the holes 234 of the deformable ring 130 can correspond to, and align with, the holes of the alignment insert 150. It should be understood that the circumference corresponding to the common radius does not necessarily correspond to a circumference of the circular outer wall 232. In some embodiments, when the holes 234 receive the rods 140, the deformable ring 130 can be positioned such that it is suspended within the hollow barrel, and in coaxial alignment with the hollow barrel 110, when the bat 100 is at rest (e.g., when the bat 100 is not striking a ball). As will be discussed more fully below, because the outer diameter of the deformable ring 130 (i.e., the diameter of the circular outer wall 232) can be less than the internal diameter of the portion of the hollow barrel 110 adjacent to the deformable ring 130, a gap can be formed between the deformable ring 130 and the hollow barrel 110.

Figure 3:
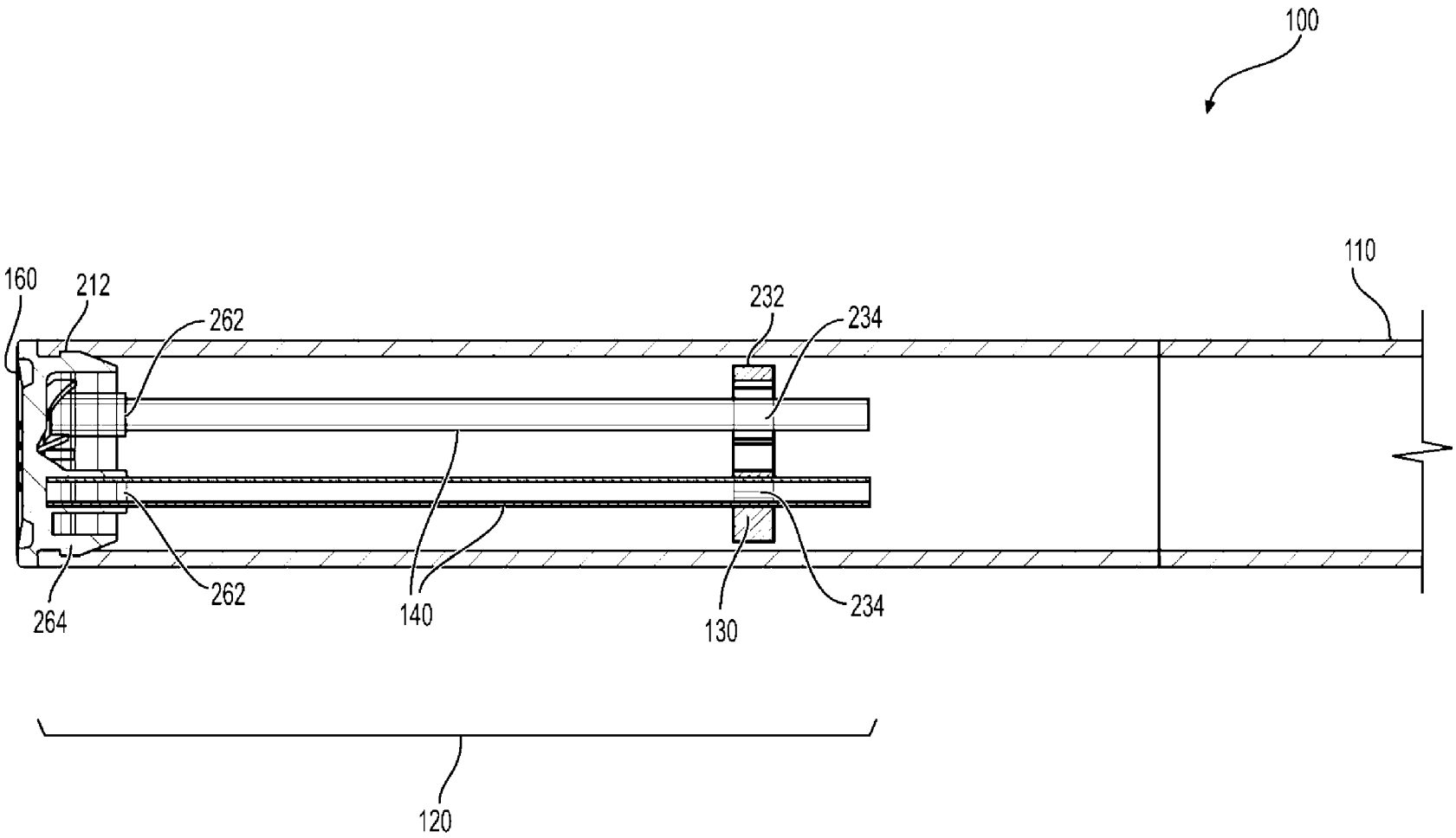
FIG. 3 is a partial cross-sectional side view of a bat, according to some embodiments of the disclosed technology.

In some embodiments, the end cap 160 can include a number of holes 262 that extend partially into the end cap 160. In some embodiments, each hole 262 can correspond to a rod 140. As shown in FIGS. 2 and 3, in some embodiments, the end cap 160 can include multiple protrusions extending from an inner surface of the end cap 160 with each protrusion including a partial hole 262. This can permit the end cap 160 to comprise a relatively lower amount of material, which can decrease the overall weight of the bat 100.

Similar to the holes 234 of the deformable ring 130, in some embodiments, each hole 262 of the end cap 160 can be positioned at a common radius from a center of the end cap 160, and in certain embodiments, the holes 234 can be positioned equidistantly about a circumference corresponding to this common radius. In certain embodiments, the common radius with respect to the deformable ring 130 can be substantially equal to the common radius with respect to the end cap 160 and/or the holes 234 of the deformable ring 130 such that each rod 140 is substantially parallel to one another. In some embodiments, the common radius with respect to the deformable ring 130 can be smaller than the common radius with respect to the end cap 160 such that each rod 140 increasingly extends radially outward as the rod 140 extends longitudinally from the deformable ring 130 toward the end cap 160; in some embodiments, this configuration can provide rods 140 that are substantially parallel to an outer wall of the hollow barrel 110 if the hollow barrel 110 increases in outer diameter from a proximate end to a distal end, but it should be understood that such a configuration of the rods 140 is not limited to embodiments in which the diameter of the hollow barrel 110 changes.

In certain embodiments, the end cap 160 can also include a protrusion 264, which can correspond to a notch 212 located proximate the distal end of the hollow barrel 110. In some embodiments, the end cap 160 can be permanently attached to the hollow barrel 110. In certain embodiments, the end cap can be attached to the hollow barrel with an adhesive, such as a glue or epoxy. In certain embodiments, the end cap 160 can be detachably attachable to the hollow barrel 110. Embodiments including a detachably attachable end cap 160 can permit multiple internal assemblies 120 and end caps 160 to be inserted into a single hollow barrel 110, which can enable a single bat 100 to be used in multiple leagues governed by rules requiring differing maximum performance metrics of bats. Thus, it should be appreciated that various components of the internal assembly 120, the end cap 160, and/or any combination thereof are herein contemplated as being provided separately from all other structures discussed herein. For example, it is contemplated that various embodiments of the deformable ring 130 can be provided separately from all other components discussed herein.

As shown throughout the figures, the designs disclosed herein utilize multiple rods 140 as opposed to a single tube or rod (e.g., located along the central axis of the barrel 110). Such designs can permit the deformable ring 130 to be more evenly displaced within the barrel 110 (i.e., translational movement of the deformable ring 130 within the barrel 110) at impact. Such even displacement of the deformable ring 130 can facilitate decreased performance restriction (e.g., as opposed to a rigid washer design) for all but the high-speed impacts (e.g., impacts at a sufficient force to cause the barrel 110 to flex inward at the impact location such that the interior wall of the barrel 110 near the impact location contacts the deformable ring 130 and causes the deformable ring 130 to contact the interior wall of the barrel 110 opposite the impact location). Thus, such designs can limit the flex of the barrel 110 (and COR of the bat 100) at high-speed impacts, while permitting free flexing of the barrel 110 at lower speeds and thus maximizing performance of the bat 100 at lower speeds.

Figure 4B:
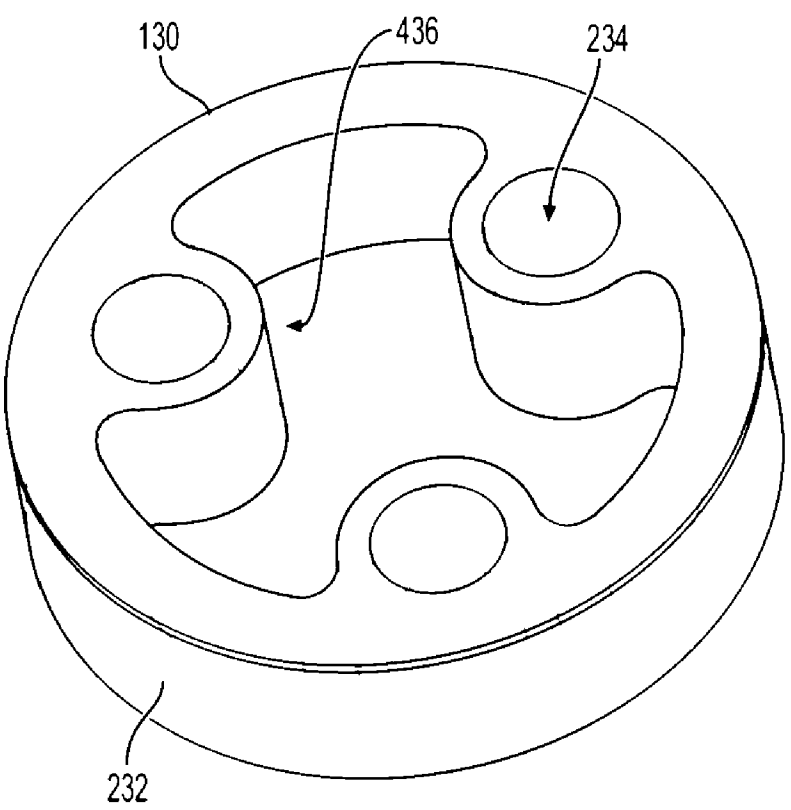
FIG. 4B is a wireframe drawing of the deformable ring depicted in FIG. 4A, according to some embodiments of the disclosed technology.
Figure 4A:
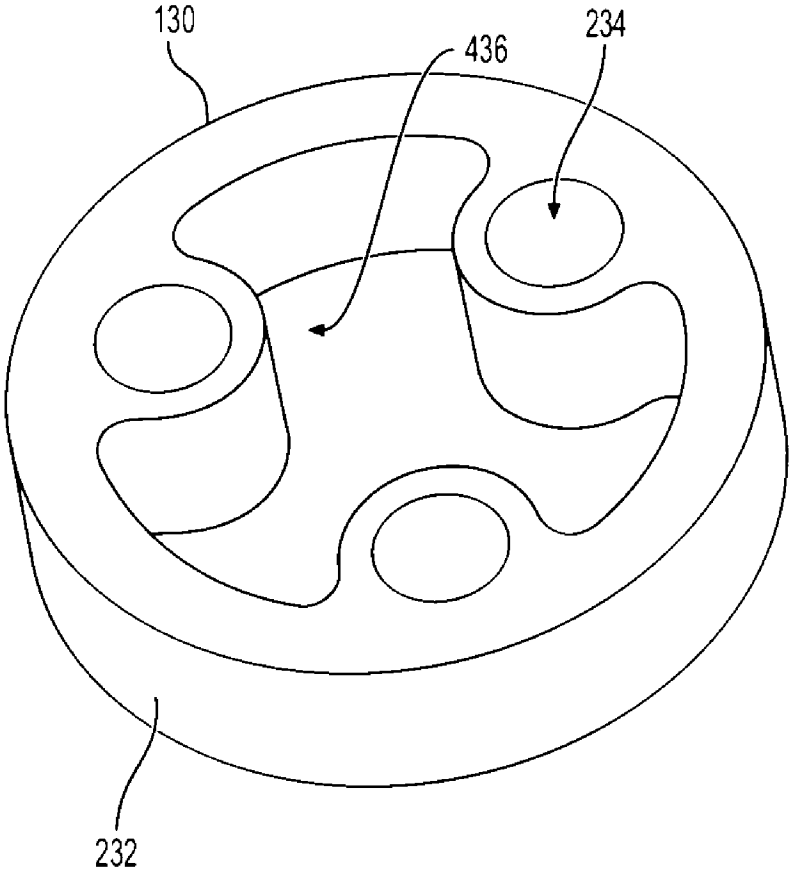
FIG. 4A is an isometric view of a deformable ring, according to some embodiments of the disclosed technology.
Figure 4D:
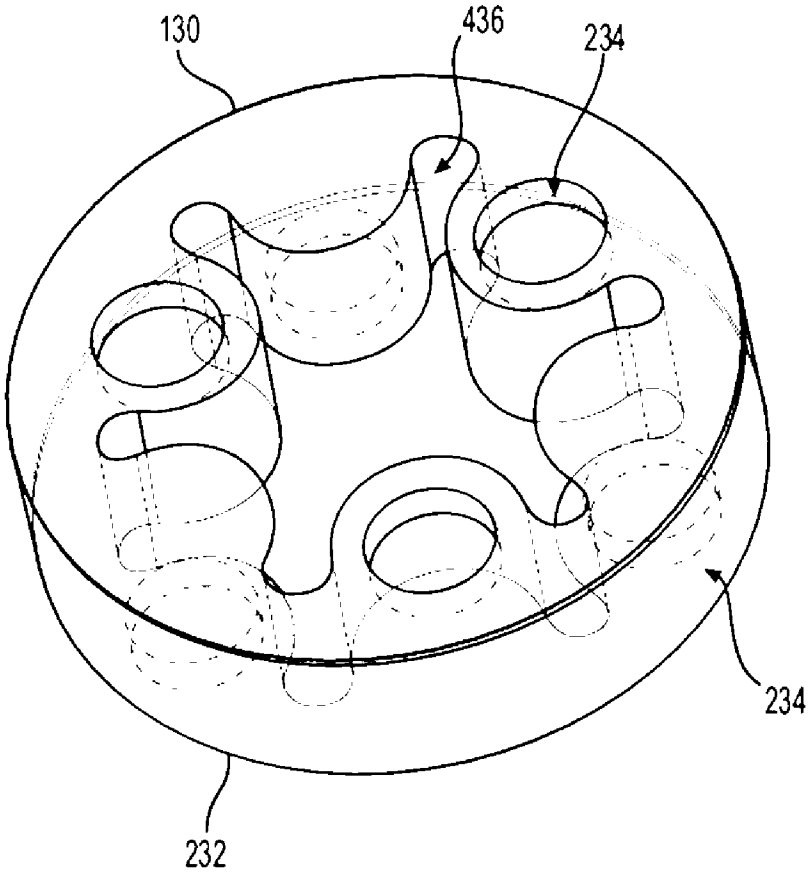
FIG. 4D is a wireframe drawing of a deformable ring, according to some embodiments of the disclosed technology.
Figure 4C:
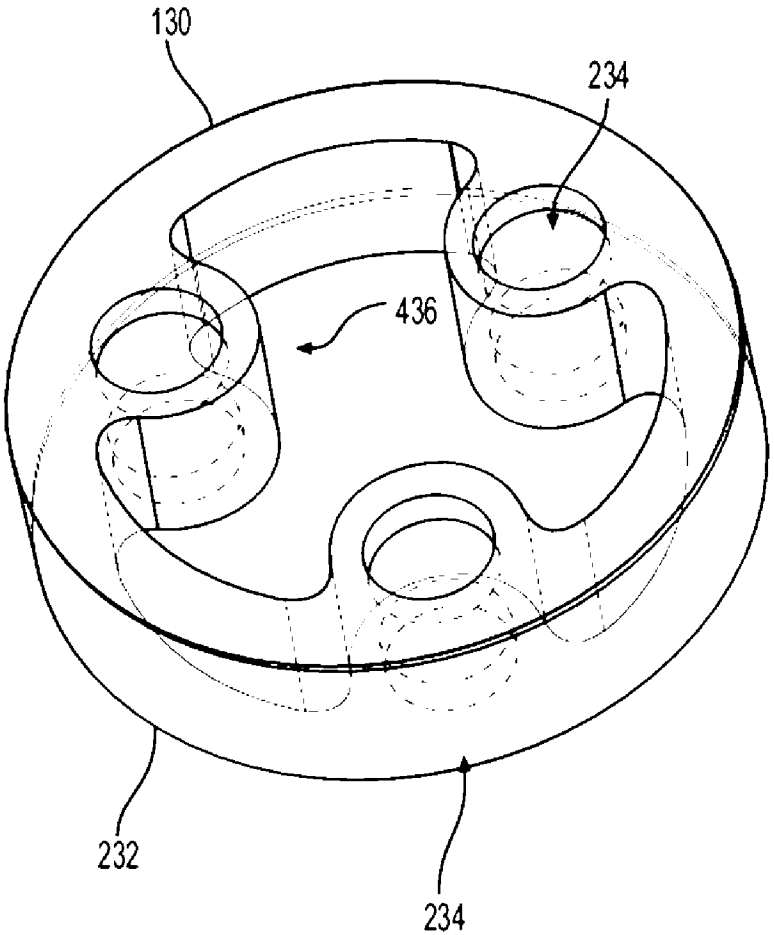
FIG. 4C is a wireframe drawing of a deformable ring, according to some embodiments of the disclosed technology.

FIGS. 4A and 4B more clearly depict the deformable ring 130 according to some embodiments, along with the circular outer wall 232 and holes 234. In some embodiments, one or more of the holes 234 can extend only partially into the deformable ring 130 such that only an end of a rod can extend into the hole 234. Some embodiments can include a combination of complete (i.e., formed fully through the deformable ring 130) and partial (i.e., formed only partially through the deformable ring 130) holes 234. Referring to FIGS. 4C and 4D, in certain embodiments, the deformable ring can include one or more holes 234 that extends partially into a first side (e.g., a top side) of the deformable ring 130 and can include one or more holes 234 that extends partially into a second side (e.g., a bottom side) of the deformable ring 130 such that an end of a first rod 140 can be inserted into the first side of the deformable ring 130 and an end of a second rod 140 can be inserted into the second side of the deformable ring 130. In some embodiments, a given pair of rods 140 on opposite sides of the deformable ring 130 (e.g., the first rod 140 inserted into the first side of the deformable ring 130 and the second rod 140 inserted into the second side of the deformable ring 130) can be axially aligned with respect to one another, such as shown in FIG. 4C. In certain embodiments, one or more of the rods 140 on opposite sides of the deformable ring 130 can be axially offset with respect to one another, such as shown in FIG. 4D.

Figure 5B:
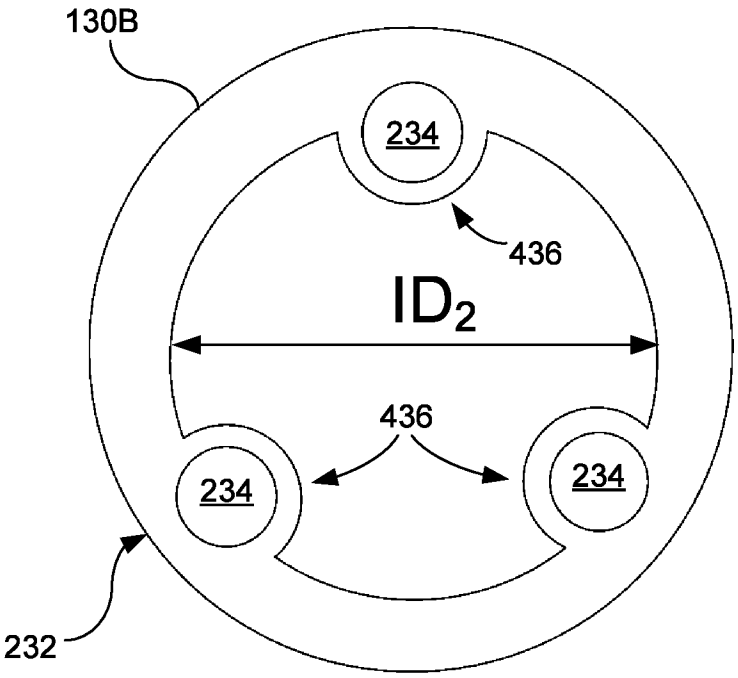
FIG. 5B is a cross-section of a deformable ring, according to some embodiments of the disclosed technology.
Figure 5A:
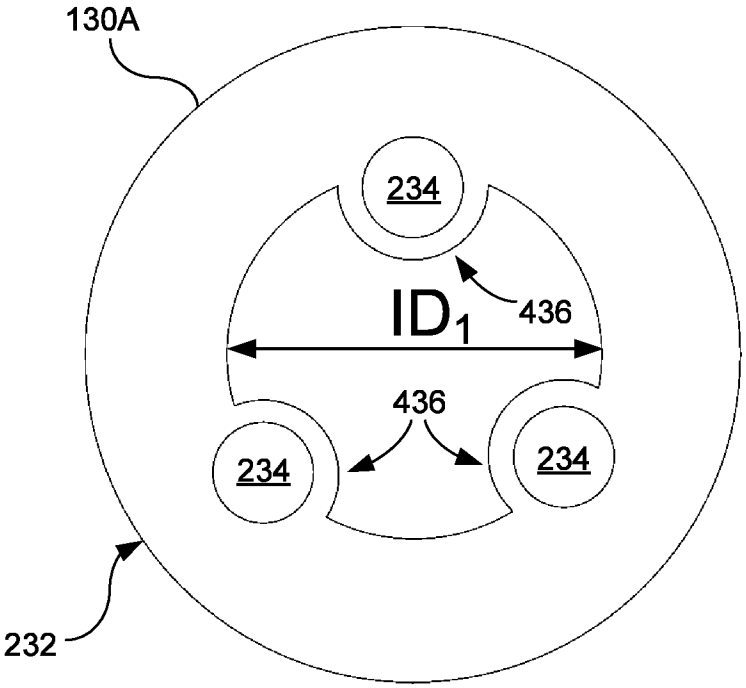
FIG. 5A is a cross-section of a deformable ring, according to some embodiments of the disclosed technology.

Referring to FIGS. 5A and 5B, in some embodiments, a plurality of deformable rings 130 can be provided, and according to some embodiments, the outer diameter of each deformable ring 130 is the same. Thus, each of the plurality of deformable rings 130 can be used with the same hollow barrel 110. In some embodiments, the diameters of the holes 234 can be different from deformable ring 130 such that rods 140 of differing diameters can be used, which can influence the deformability of the deformable ring 130. In certain embodiments, the diameters of the holes 234 can be the same among all deformable rings 130 such that the same rods 140 can be used for all deformable rings 130. In some embodiments, the inner diameter of the deformable rings 130 can be adjusted to provide differing rigidities and thus differing deformability of the hollow barrel 110, ultimately resulting in differing performance characteristics of the bat 100. For example, FIG. 5A depicts a deformable ring 130A having an outer diameter and an inner diameter ID', and FIG. 5B depicts a deformable ring 130B having the same outer diameter as deformable ring 130A and having an inner diameter $ID_2$, which is greater than the inner diameter Di of deformable ring 130A. Because deformable rings 130A and 130B have the same outer diameter and because deformable ring 130A has an inner diameter Di less than the inner diameter $ID_2$ of deformable ring 130B, deformable ring 130A has a greater wall thickness than that of deformable ring 130B. Accordingly, deformable ring 130A is more rigid, and thus less deformable, than deformable ring 130B.

In some embodiments, the deformable ring 130 can have a thickness (e.g., height) in the range of approximately 1 mm (approximately 0.04 inch) to approximately 50 mm (approximately 2 inches). For example, in some embodiments, the deformable ring 130 can have a thickness (e.g., height) in the range of approximately 1 mm (approximately 0.04 inch) to approximately 20 mm (approximately 0.8 inch). In certain embodiments, the deformable ring 130 can have a radial thickness (e.g., the smallest thickness of a sidewall of the deformable ring) in the range of approximately 1 mm (approximately 0.04 inch) to approximately 50 mm (approximately 2 inches). For example, in some embodiments, the deformable ring 130 can have a radial thickness in the range of approximately 5 mm (approximately 0.2 inch) to approximately 30 mm (approximately 1.2 inches). In some embodiments, the deformable ring can comprise one or more metals (e.g., aluminum), resin, one or more composite materials, one or more plastics (e.g., nylon), any combination thereof, or any other appropriate material(s).

Figure 6A:
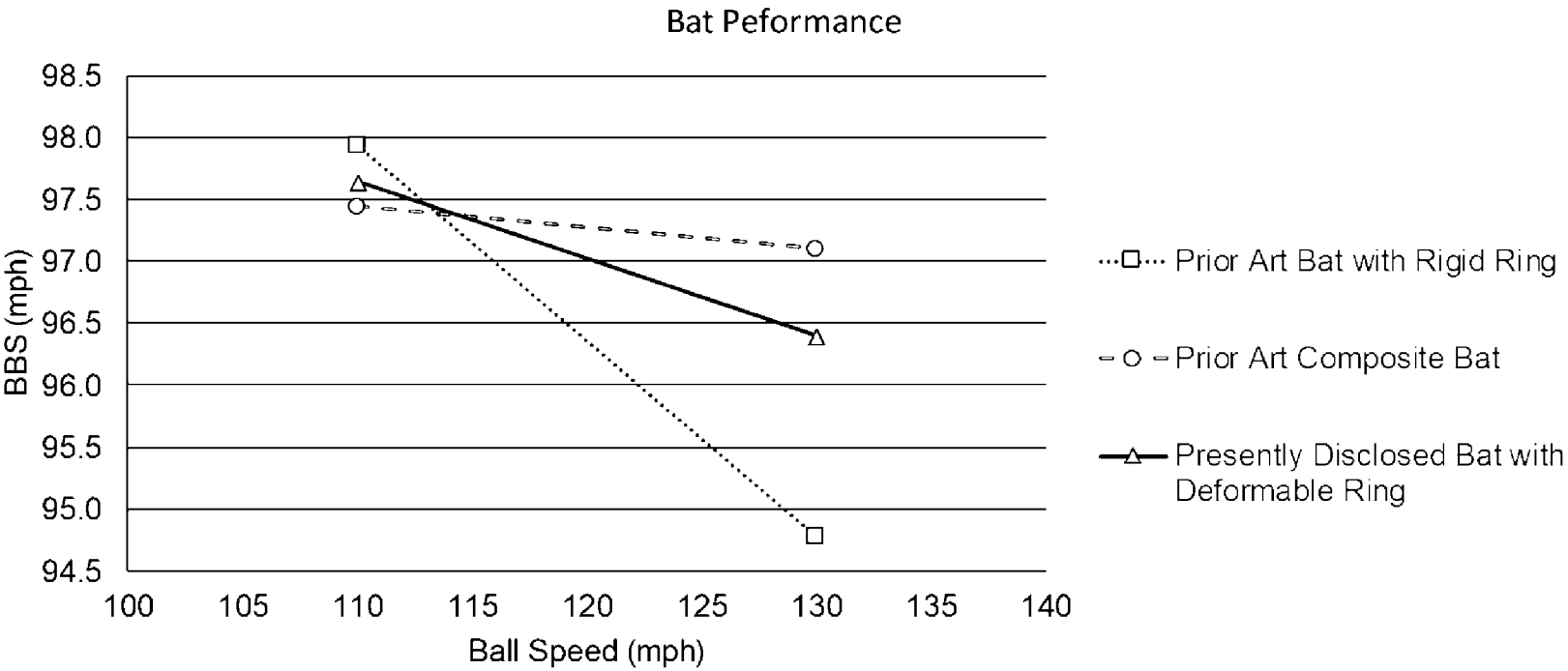
FIG. 6A is a graph illustrating performance of a bat incorporating an embodiment of the presently disclosed technology as compared to that of two prior art bats.
Figure 6B:
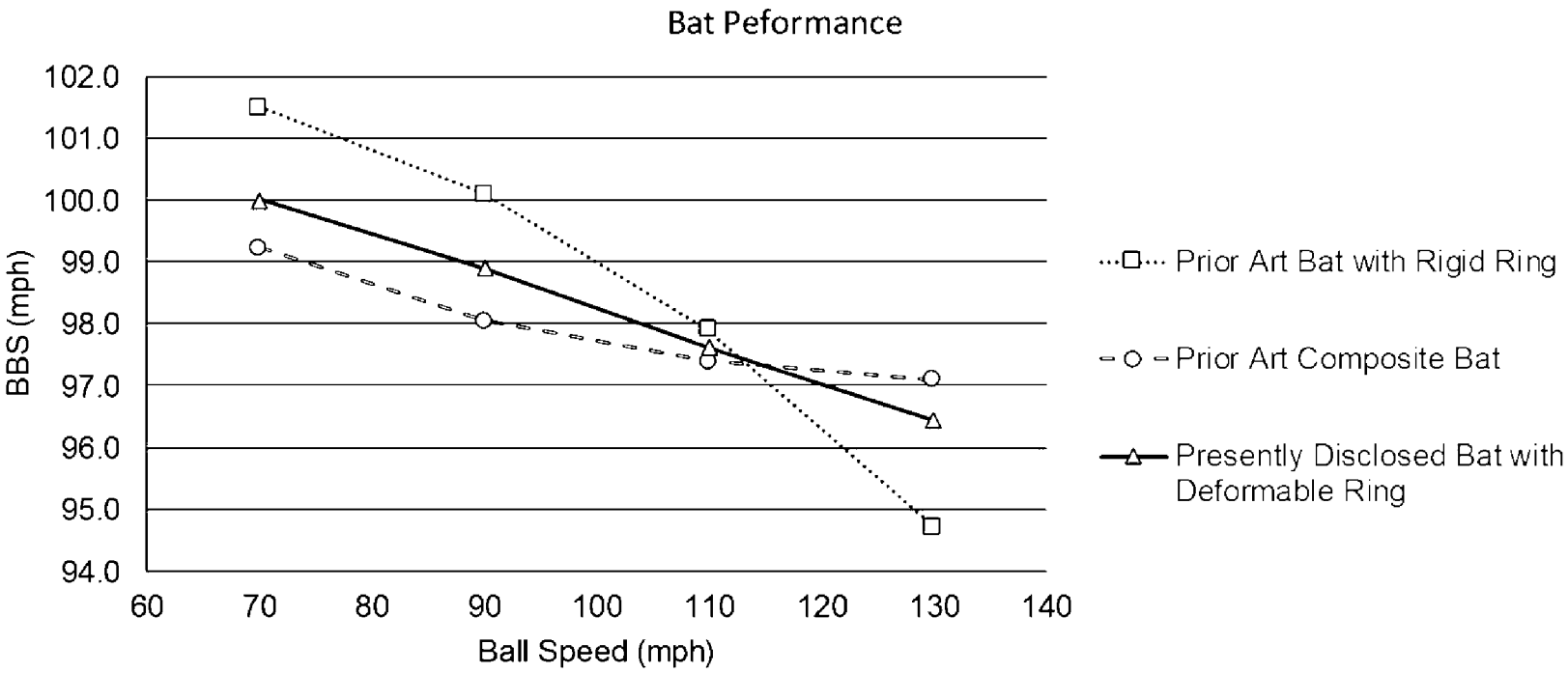
FIG. 6B is a graph illustrating performance of a bat incorporating an embodiment of the presently disclosed technology as compared to that of two prior art bats.
Figure 7:
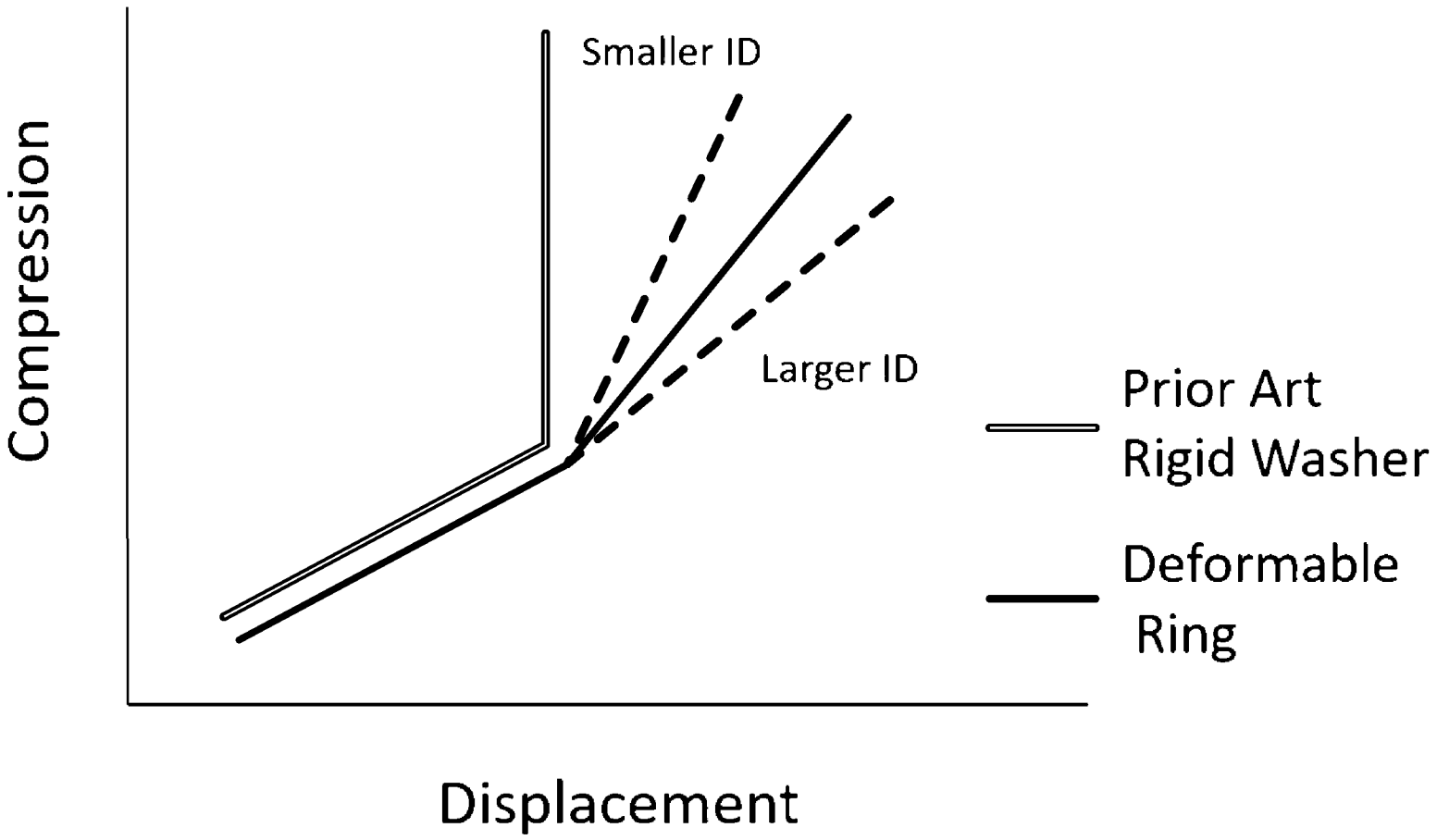
FIG. 7 is a graph illustrating a comparison of the compression and displacement of a prior art rigid washer and a deformable ring, according to some embodiments of the disclosed technology.

FIGS. 6A and 6B are graphs depicting the performance of three types of bats: a prior art bat having a rigid, washer-shaped ring, a prior art composite bat lacking any sort of internal ring structure, and a bat comprising the presently disclosed technology. As can be seen, the presently disclosed bat provides a batted ball speed that is higher than the normal composite bat and nearly as high as the bat including the washer-shaped ring at lower speeds and provides a batted ball speed that is higher than the bat including the washer-shaped ring and nearly as high as the normal composite bat at medium speeds. And at higher speeds, the presently disclosed bat provides a batted ball speed that is much higher than the bat including the washer-shaped ring. Thus, the presently disclosed can increase bat performance at a target force (e.g., to conform with controlling rules and regulations) while maintaining a high level of performance at forces beyond the target force. The increased overall performance of bats using a deformable ring 130 can be at least partly attributable to the unique balance of compression and displacement afforded by the disclosed technology. Referring to FIG. 7, a rigid washer of a prior art bat can be displaced within the bat as the bat barrel is compressed only until the rigid washer is in contact with both the impact side and opposite side of the barrel, at which time no further displacement is possible. In contrast, the deformable ring 130 of the disclosed technology can displace similarly but is also able to deform after contacting both the impact side and opposite side of the barrel. As can also be seen from FIG. 7, the degree of compression of the deformable ring 130 can be altered based on the inner diameter of the deformable ring 130 (assuming a constant outer diameter). Stated otherwise, the thickness of the deformable ring's 130 outer wall can affect the degree of compression of the deformable ring 130.

Figure 8:
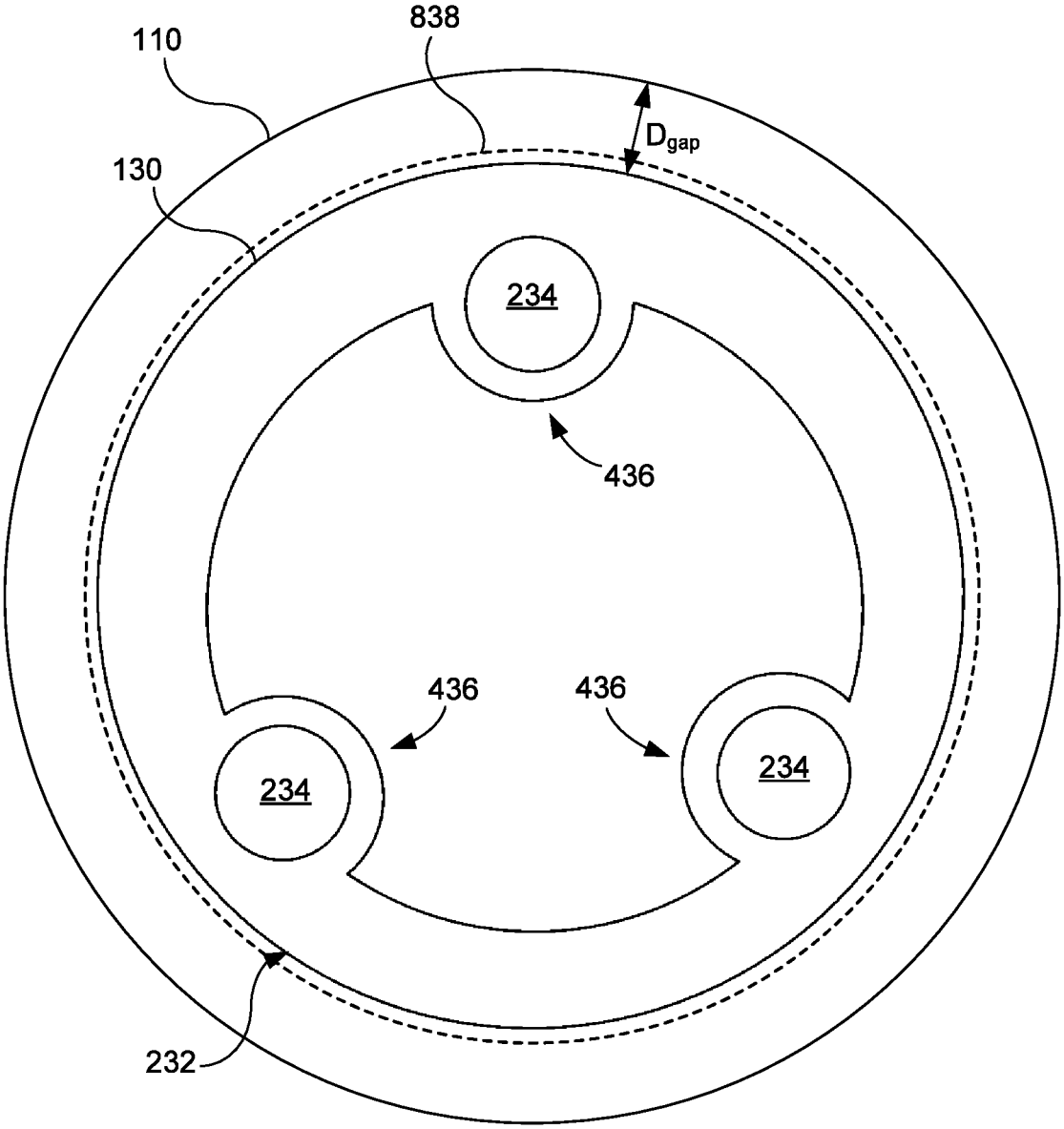
FIG. 8 is a cross-section of a deformable ring within a hollow barrel, according to some embodiments of the disclosed technology.

As shown in FIG. 8, the deformable ring 130 can be suspended within the hollow barrel 110 such that a gap is formed between the circular outer wall 232 of the deformable ring 130 and the interior surface of the hollow barrel 110. The magnitude of this gap (i.e., distance $D_{gap}$) can be altered to achieve a predetermined performance at various batted ball speeds. As will be appreciated, the outer surface of the deformable ring 130 and/or the inner surface of the barrel 110 may not be perfectly circular due to manufacturing limitations or other reasons. Thus, the gap distance $D_{gap}$ can refer to an average gap distance $D_{gap}$ between the outer surface of the deformable ring 130 and the inner surface of the barrel 110.

Optionally, a compressible material 838 can be attached or affixed to the outer wall 232 of the deformable ring 130. The compressible material 838 can help to reduce or eliminate vibrations that can cause an undesirable sound (e.g., a rattling sound) that may occur when the deformable ring 130 contacts the inner surface of the barrel 110. The compressible material 838 can be or include a fabric (e.g., felt), a foam (e.g., a low-density polyurethane foam), or any other compressible material. As will be appreciated, the compressible material 838 can be highly compressible such that it can dampen, reduce, and/or remove audible rattling without inhibiting the benefits of the deformable ring 130 as described herein. The compressible material 838 can be attached or affixed to the outer wall 232 of the deformable ring 130 via adhesive (e.g., glue, epoxy, tape) or any type of attachment device. As a non-limiting example, the compressible material 838 can be a tape (e.g., a felt tape, a foam tape) and can be adhered to the outer wall 232 of the deformable ring 130. Alternatively or in addition, a compressible material 838 can be attached or affixed to the inner surface of the barrel 110. The compressible material 838 can have a thickness that is less than the gap distance $D_{gap}$ such that a gap exists between the compressible material 838 and the inner surface of the barrel 110 (if the compressible material 838 is attached to the outer wall 232 of the deformable ring 130) or between the compressible material 838 and the outer wall 232 of the deformable ring 130 (if the compressible material 838 is attached to the inner surface of the barrel 110). Alternatively, the compressible material 838 can have a thickness that is approximately equal to the gap distance $D_{gap}$. Further, while the compressible material 838 has heretofore been described as being attached to the outer wall 232 of the deformable ring 130 and/or the inner surface of the barrel 110, it is contemplated that the compressible material 838 can be simply disposed between the deformable ring 130 and the barrel 110. For example, the compressible material 838 can have a thickness that approximately equal to or greater than (e.g., slightly greater than) the gap distance $D_{gap}$ such that the compressible material can be retained between the deformable ring 130 and the barrel 110 via friction forces and/or slight compression of the compressible material 838. Regardless of its positioning, the compressible material 838 can be positioned such that it prevents direct contact between the deformable ring 130 and the barrel 110.

Table 1 below refers to data resulting from experiments conducted using examples of the disclosed technology, including two samples having rings of differing wall thickness and the same outer diameter (i.e., having differing inner diameters) and three samples having different outer diameters. Each sample was tested with the same hollow barrel 110, such that the difference between the inner diameter of the hollow barrel 110 and the outer diameter of each sample deformable ring 130 results in a corresponding gap distance $D_{gap}$. The barrel 110 used in testing these samples had an inner diameter of approximately 50 mm (approximately 2 inches). Thus, as an example, the gap distance $D_{gap}$ for Sample A, which included a ring 130 having an outer diameter of 36 mm (approximately 1.4 inches), was approximately 7 mm (approximately 0.28 inches) (i.e., (50 mm outer diameter of barrel 110—36 mm outer diameter of deformable ring 130)÷2=7 mm $D_{gap}$ for Sample A). The force values of Table 1 refer how much force was required to compress the barrel 110 of each sample a constant, predetermined amount. For the purposes of these experiments, the predetermined displacement resulting from the compression of the barrel 110 was 0.050±0.001 inch (1.3±0.025 mm). Ring wall thickness refers to the difference between the deformable ring's 130 outer diameter and largest inner diameter (see, e.g., FIGS. 5A and 5B), ring height refers to the height of thickness of each deformable ring 130, and ring location refers to the position of each deformable ring 130 with respect to the cap end of the barrel of the bat (i.e., each of the samples was located at a position 7 inches from the cap end of the barrel 110). Each sample was tested using a robotic batter at a low speed, a medium speed, and a high speed.

TABLE 1

| Sample | Force (lbf) | Ring Outer Diameter (mm) | Ring Wall Thickness (mm) | Ring Height (mm) | Ring Location (in) |
|---|---|---|---|---|---|
| A | 255 | 36 | 4.0 | 10.0 | 7.0 |
| B | 251 | 40 | 4.5 | 10.0 | 7.0 |
| C | 249 | 44 | 5.0 | 10.0 | 7.0 |
| D | 250 | 40 | 3.0 | 10.0 | 7.0 |

Table 2 below shows the batted ball speed resulting from impacts of some of the above sample bats with balls traveling at three different speeds prior to impact: low speed (55 km/h (approximately 34 mph)), medium speed (80 km/h (approximately 50 mph)), and high speed (125 km/h (approximately 78 mph)). To determine the batted ball speed in this data, a swing robot was used for testing (not a bat cannon), and the exit velocity of ball was then measured. As can be seen from the data, there is little difference between the performances of Samples A, B, and C at the low and medium speeds. At the high speed, however, the biggest gap resulted in the best performance. This could be because contact between the barrel 110 and the deformable ring 130 is comparatively delayed, thus permitting the barrel 110 to flex farther and also spring back farther.

TABLE 2

| Sample | 55 km/h | 80 km/h | 125 km/h |
|---|---|---|---|
| A | 49.9 | 74.2 | 119.6 |
| B | 49.9 | 74.1 | 118.1 |
| C | 50.1 | 74.0 | 118.1 |

Table 3 below shows the batted ball speed resulting from impacts of some of the above sample bats with balls traveling at three different speeds prior to impact: low speed (55 km/h (approximately 34 mph)), medium speed (80 km/h (approximately 50 mph)), and high speed (105 km/h (approximately 65 mph)). As above, the batted ball speed in this data was determined during testing using a swing robot (not a bat cannon) and measuring the exit velocity of ball. Here, the data seems to indicate that a less stiff deformable ring 130 (e.g., having a thinner wall) provides comparatively increased performance.

TABLE 3

| Sample | 55 km/h | 80 km/h | 125 km/h |
|---|---|---|---|
| B | 49.9 | 74.1 | 97.6 |
| D | 50.7 | 74.3 | 99.2 |

Figure 9A:
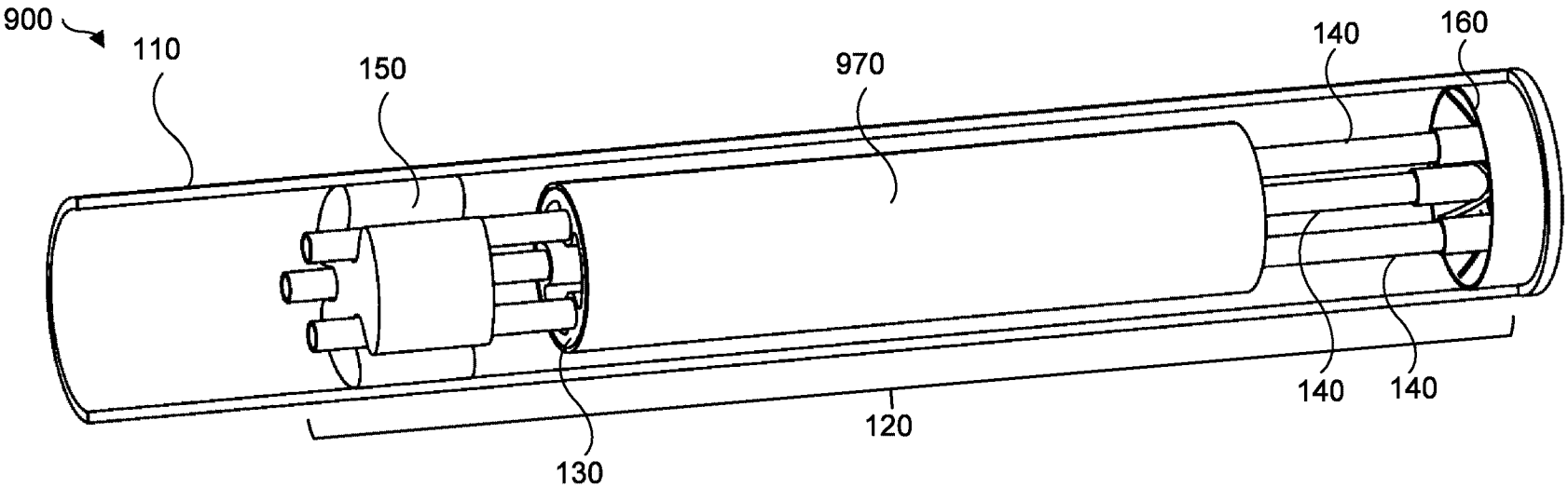
FIG. 9A is an isometric view of another bat with the barrel shown as a cutaway for clarity, according to some embodiments of the disclosed technology.
Figure 9B:
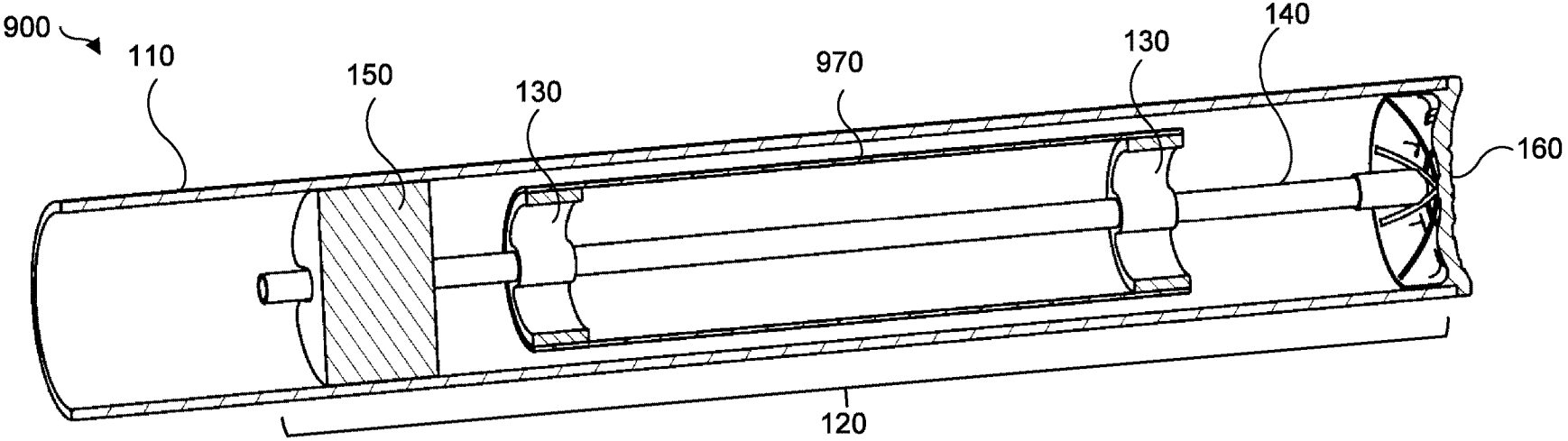
FIG. 9B is an isometric view of the bat with the barrel and internal assembly shown as a cross-section for clarity, according to some embodiments of the disclosed technology.
Figure 10:
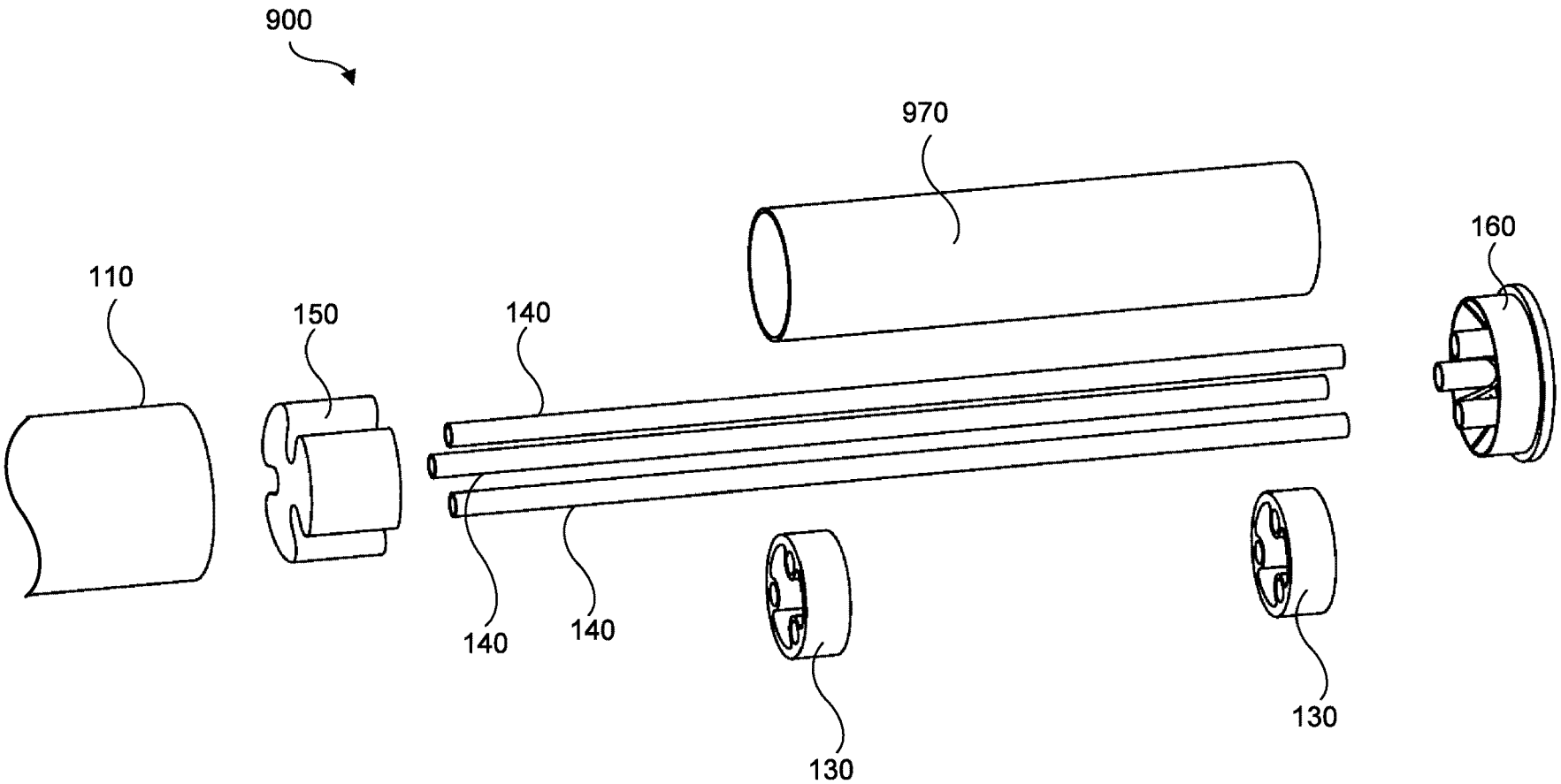
FIG. 10 is an exploded view of a bat, according to some embodiments of the disclosed technology.

Turning now to FIGS. 9A-12C another example of the bat is shown. FIG. 9A is an isometric view of another bat 900 with the barrel 110 shown as a cutaway for clarity while FIG. 9B is an isometric view of the bat 900 with the barrel 110 and internal assembly 120 shown as a cross-section for clarity, according to some embodiments of the disclosed technology. The bat 900 can include all of the same features of the bat 100 previously described herein. For example, as shown in FIGS. 9A-10, the bat 900 can include a barrel 110, an internal structure 120, and an end cap 160. The internal structure 120 can include one or more deformable rings 130, one or more rods 140, an alignment insert 150, and a deformable sleeve 970 as shown. Except for the deformable sleeve 970, the features of each of these components just named can include the same features, functions, properties, etc. previously described above.

As shown in FIGS. 9A and 9B, the deformable sleeve 970 can be disposed around the deformable rings 130 and suspended in the barrel 110 via the rods 140. In some examples, the deformable sleeve 970 can extend between one or more deformable rings 130 and either be attached to the deformable rings 130, frictionally engaged with the deformable rings 130, or be detached to the deformable rings 130.

The deformable sleeve 970 can be configured to deform when a force is applied to it. For example, when the bat 900 is used to hit a ball and the barrel 110 flexes as a result of the impact, the barrel 110 can flex inwardly until it contacts the deformable sleeve 970 and the deformable sleeve 970 can deform as a result of the force. As will be appreciated, the deformable sleeve 970 can be resilient or otherwise spring back into shape thereby transferring some of the energy back to the barrel 110 and subsequently the ball. In this way, the deformable sleeve 970 can act similar to the deformable rings 130. As will be appreciated, however, rather than being positioned in discrete locations as are the deformable rings 130, the deformable sleeve 970 can be configured to extend between deformable rings 130 along a greater portion of the barrel 110. As such, the deformable sleeve 970 can extend a greater distance than the deformable rings 130 alone, thereby increasing the size of the sweet spot on the bat 900 without significantly increasing the weight of the bat 900.

Because the bat 900 includes a deformable sleeve 970, the deformable rings 130 can be made from the same flexible materials previously described or be made from more rigid materials. If the deformable rings 130 are made from a flexible material, both the deformable rings 130 and the deformable sleeve 970 can be configured to transfer energy back to the barrel 110 after being compressed by the force applied by contacting a ball.

The deformable sleeve 970 can be made from resilient material including, but not limited to, aluminum, polymers, glass fiber composites, carbon fiber composites, etc. In some examples, the deformable sleeve 970 can be made from carbon fiber composites and/or glass fiber composites having various layup orientations. For example, various layers of the carbon fiber composites and/or glass fiber composites can be layered with the fibers generally being oriented in 0°, 30°, 45°, 60°, and/or 90° angles in relation to a longitudinal direction of the deformable sleeve 970. As will be appreciated, the number of layers, order of layers, size of fibers, orientation of layers, resin material, etc. will affect the ability of the deformable sleeve 970 to deflect and the force required to deflect the deformable sleeve 970.

Figure 11:
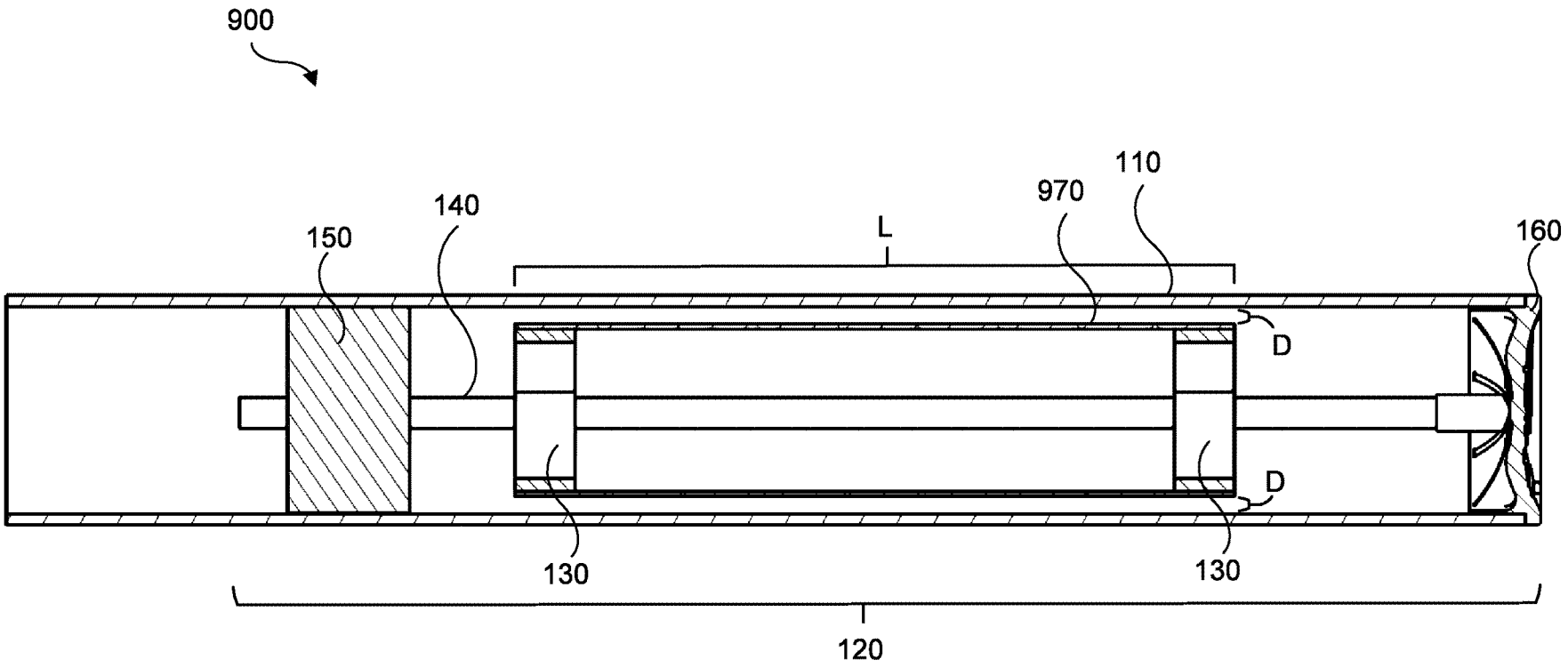
FIG. 11 is a cross-sectional side view of a bat, according to some embodiments of the disclosed technology.

As shown in FIG. 11, the deformable sleeve 970 can be extend a length L of the barrel 110. The length L can range between the entire length of the barrel 110 or only a few inches depending on the configuration. In some examples, the sleeve 970 can be configured to extend a length L that is substantially in an area of the bat 900 where a batter is most likely to hit the ball. For example, the sleeve 970 can be disposed in the barrel 110 approximately 3 to 10 inches from the end of the end cap 160 and extend the length of a preferred striking area of the bat 900. In other examples, the sleeve 970 can be disposed in the barrel 110 approximately 5 to 9 inches from the end cap 160.

As shown in FIG. 11, the deformable sleeve 970 can be suspended in the barrel 110 such that a gap having a distance D can be between an outer surface of the deformable sleeve 970 and an inner surface of the barrel 110. As before, the magnitude of this gap (i.e., distance D) can be altered to achieve a predetermined performance at various batted ball speeds. As will be appreciated, the outer surface of the deformable sleeve 970 and/or the inner surface of the barrel 110 may not be perfectly circular due to manufacturing limitations or other reasons. Thus, the gap distance D can refer to an average gap distance D between the outer surface of the deformable ring 130 and the inner surface of the barrel 110. The distance D of the gap, for example, can be approximately 0.2 mm (0.00787 inches) to approximately 10 mm (0.394 inches).

Figure 12A:
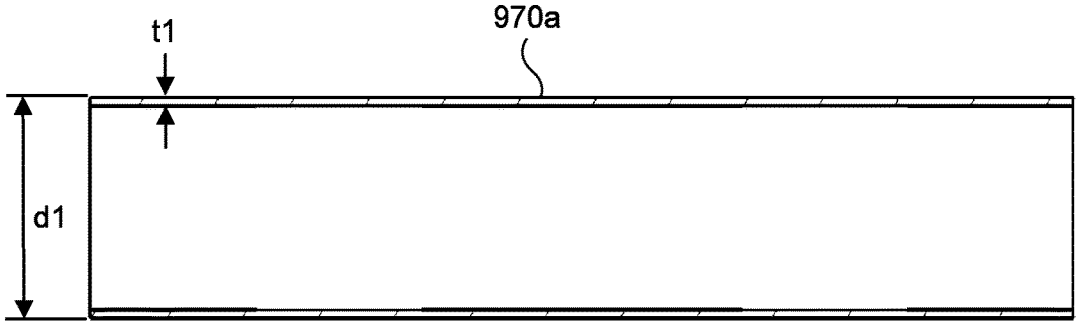
FIGS. 12A-12C illustrate various cross-sectional views of a sleeve of a bat, according to some embodiments of the disclosed technology.
Figure 12B:
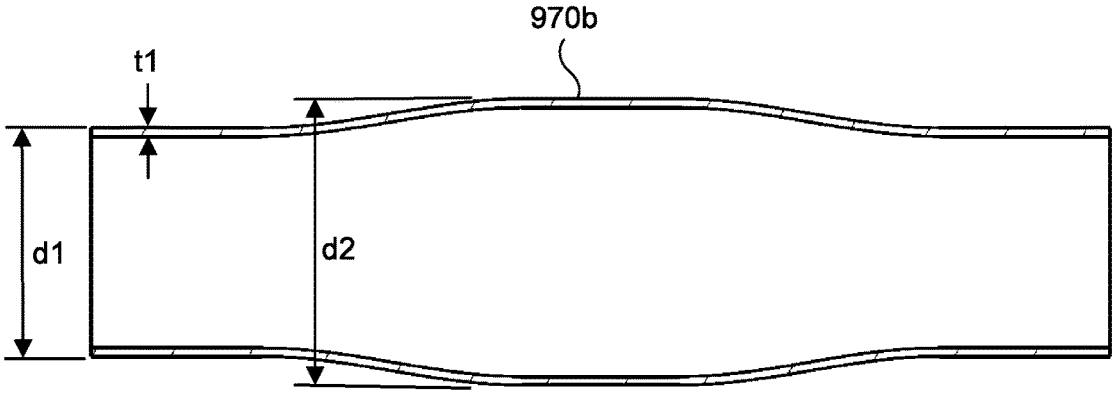
Figure 12C:
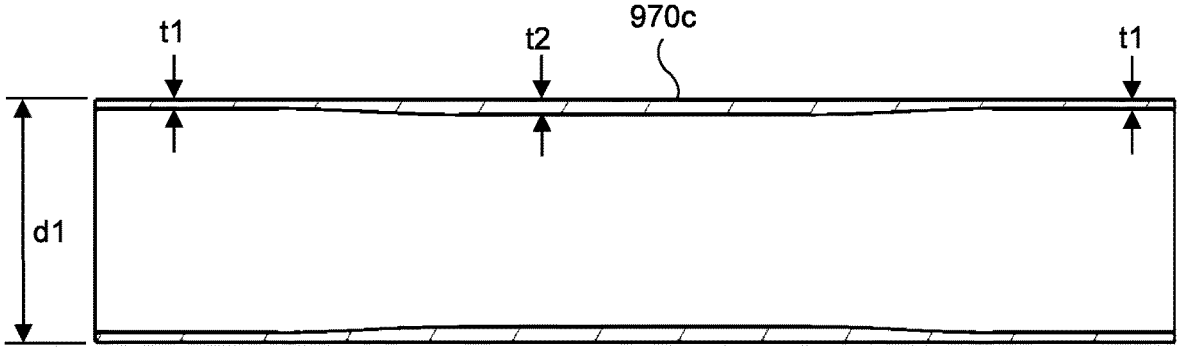

FIGS. 12A-12C illustrate various cross-sectional views of a deformable sleeve 970 of the bat 900, according to some embodiments of the disclosed technology. As shown in FIG. 12A, the deformable sleeve 970 can have a constant wall thickness t and a constant outer diameter d1 along the length of the deformable sleeve 970. In other examples, the wall thickness t and the outer diameter d1 can be varied as shown in FIGS. 12B and 12C. For example, as shown in FIG. 12B, the deformable sleeve 970 can have a first outer diameter d1 and a second outer diameter d2 that is greater than the first outer diameter d1. As will be appreciated, increasing the outer diameter of the deformable sleeve 970 means that the barrel 110 of the bat 900 is more likely to contact the portion of the deformable sleeve 970 at the location of the greater second diameter d2 than at the location of the smaller first diameter d1. Thus, the deformable sleeve 970 can be formed to have an increased diameter (d2) at locations where it is desirable for the barrel 110 to contact the deformable sleeve 970 before contacting other portions of the deformable sleeve (e.g., at locations having the first outer diameter d1). In other examples, the second outer diameter d2 can be smaller than the first outer diameter d1 such that the deformable sleeve 970 can be formed to have a decreased diameter (d2) at locations where it is desirable for the barrel 110 to contact the deformable sleeve 970 subsequent to contacting other portions of the deformable sleeve 970 (e.g. at locations having the first outer diameter d1).

As another example, the deformable sleeve 970 can have a varying wall thickness across the length of the deformable sleeve 970. For example, as shown in FIG. 12C, the deformable sleeve 970 can have a first wall thickness t1 at a first location and a second wall thickness t2 at a second location. The second wall thickness t2 can be greater than the first wall thickness t1. In other examples, although not shown, it will be appreciated that the second wall thickness t2 can be less than the first wall thickness t1. As will be appreciated, by increasing the wall thickness, the deformable sleeve 970 can be made to be more rigid. Thus, the deformable sleeve 970 can be formed to include a thicker wall in locations where it would be desirable for the bat 900 to have a more rigid or stiff deformable sleeve 970. Furthermore, the deformable sleeve 970 can include some combination of varying thickness t and outer diameter d to affect the performance of the bat 900 as desired. Furthermore, more than one deformable sleeve 970 can be disposed inside of the barrel 110. For example, the bat 900 can include multiple deformable sleeves 970 disposed side by side (with or without a space in between) with each deformable sleeve 970 having varying length, thickness, and/or outer diameter as would be preferable for the particular application.

Because the bat 900 includes an inner sleeve 970 that extends some length of the barrel 110, the bat 900 can exhibit improved sound and feeling as compared to previous designs. For example, the inner sleeve 970 can produce a similar effect to that of the deformable rings 130 but help to reduce the overall vibrations resulting from hitting a ball. Thus, the inner sleeve 970 can produce an impact sound and feel that tends to be more desirable for avid baseball and softball players.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A bat comprising:

a hollow barrel;

an internal assembly disposed in the hollow barrel, the internal assembly comprising:

a rod disposed longitudinally in the hollow barrel;

a ring attached to the rod; and a deformable sleeve disposed around the ring and extending longitudinally in the hollow barrel, the deformable sleeve having an outer diameter smaller than an inner diameter of the hollow barrel;

an end cap attached to an end of the hollow barrel, the end cap having a recess configured to receive an end of the rod, wherein the rod is configured to maintain the deformable sleeve in a predetermined suspended position within the hollow barrel such that, when the bat is at rest, the deformable sleeve is disposed a predetermined gap distance from an inner surface of the hollow barrel.

2. The bat of claim 1, wherein responsive to receiving force from an impact with an object, the hollow barrel is configured to flex inwardly such that the inner surface of the hollow barrel contacts the deformable sleeve.

3. The bat of claim 2, wherein:

the hollow barrel is configured to transfer at least some of the force from the impact to the deformable sleeve, and the deformable sleeve is configured to:

at least partially deform from an original shape to a deformed shape upon receiving the at least some of the force from the impact; and return from the deformed shape to the original shape.

4. The bat of claim 3, wherein the deformable sleeve is further configured to transfer a rebound force to the hollow barrel as the deformable sleeve returns from the deformed shape to the original shape.

5. The bat of claim 3, wherein:

the ring is a deformable ring, the hollow barrel is configured to transfer at least some of the force from the impact to the deformable ring, and the deformable ring is configured to:

at least partially deform from an original shape to a deformed shaped upon receiving the at least some of the force from the impact; and return from the deformed shape to the original shape.

6. The bat of claim 1, wherein the ring is a first ring and the internal assembly further comprises a second ring, the second ring being attached to the rod and spaced a distance from the first ring, and wherein the deformable sleeve extends between the first ring and the second ring.

7. The bat of claim 6, wherein the deformable sleeve comprises a first outer diameter proximate the first ring and proximate the second ring and a second outer diameter between the first ring and the second ring, the second outer diameter being greater than the first outer diameter.

8. The bat of claim 6, wherein the deformable sleeve comprises a first outer diameter proximate the first ring and proximate the second ring and a second outer diameter between the first ring and the second ring, the second outer diameter being less than the first outer diameter.

9. The bat of claim 6, wherein the deformable sleeve comprises a first thickness proximate the first ring and proximate the second ring and a second thickness between the first ring and the second ring, the second thickness being greater than the first thickness.

10. The bat of claim 6, wherein the deformable sleeve comprises a first thickness proximate the first ring and proximate the second ring and a second thickness between the first ring and the second ring, the second thickness being less than the first thickness.

11. The bat of claim 1, wherein the internal assembly further comprise an alignment insert comprising:

an outer diameter approximately equal to the inner diameter of the hollow barrel; and a lobe configured to receive a portion of the rod.

12. The bat of claim 1 further comprising a plurality of rods, wherein the ring comprises a plurality of holes, each hole of the plurality of holes being configured to at least partially receive a respective rod of the plurality of rods.

13. The bat of claim 12, wherein:

the bat has a central axis;

the ring has a central axis aligned with the central axis of the bat, and the plurality of holes of the ring is disposed equidistantly about a circumference corresponding to a radial distance from the central axis of the bat.

14. The bat of claim 12, wherein the end cap further comprises a plurality of recesses configured to at least partially receive an end of a respective rod of the plurality of rods.

15. The bat of claim 14, wherein:

the end cap has a central axis aligned with the central axis of the bat, and the plurality of recesses of the end cap is disposed equidistantly about a circumference corresponding to a radial distance from the central axis of the bat.

16. The bat of claim 12 further comprising an alignment insert comprising:

an outer diameter approximately equal to the inner diameter of the hollow barrel; and a plurality of lobes, each lobe configured to at least partially receive a respective rod of the plurality of rods.

17. The bat of claim 16, wherein each of the plurality of lobes of the alignment insert is offset from a central axis of the alignment insert by a radial distance.

18. An internal assembly for a bat comprising:

a rod;

a ring attached to the rod; and a deformable sleeve disposed around the ring and configured to extend longitudinally in a hollow barrel of the bat, the deformable sleeve having an outer diameter smaller than an inner diameter of the hollow barrel, wherein the rod is configured to maintain the deformable sleeve in a predetermined suspended position within the hollow barrel such that, when the bat is at rest, the deformable sleeve is disposed a predetermined gap distance from an inner surface of the hollow barrel.

19. The internal assembly of claim 18, wherein the ring is a first ring and the internal assembly further comprises a second ring, the second ring being attached to the rod and spaced a distance from the first ring, and wherein the deformable sleeve extends between the first ring and the second ring.

20. The internal assembly of claim 19 further comprising an alignment insert comprising:

an outer diameter approximately equal to an inner diameter of a hollow barrel of the bat; and a lobe configured to at least partially receive a portion of the rod.

* * * * *